US006264317B1

(12) United States Patent
Raulinaitis et al.

(10) Patent No.: US 6,264,317 B1
(45) Date of Patent: Jul. 24, 2001

(54) CORROSION RESISTANT PRINTHEAD BODY FOR INK JET PEN

(75) Inventors: Michael Raulinaitis; Jeanne Marie Saldanha Singh; Gary Raymond Williams, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/443,625

(22) Filed: Nov. 19, 1999

(51) Int. Cl.[7] ..... B41J 2/175
(52) U.S. Cl. ..... 347/86; 347/45; 347/46
(58) Field of Search ..... 347/20, 45, 46, 347/47, 63, 64, 86, 87

(56) References Cited

U.S. PATENT DOCUMENTS

| | | | |
|---|---|---|---|
| 5,288,340 | 2/1994 | Christ et al. | 148/217 |
| 5,348,913 | 9/1994 | McBride et al. | 437/209 |
| 5,426,458 | 6/1995 | Wenzel et al. | 347/45 |
| 5,622,896 | 4/1997 | Knotter et al. | 438/123 |
| 5,693,928 | 12/1997 | Egitto et al. | 204/157.15 |
| 5,709,754 | 1/1998 | Morinville et al. | 134/1.3 |
| 5,780,118 | 7/1998 | Tracy et al. | 427/508 |
| 6,062,679 * | 5/2000 | Meyer et al. | 347/63 |
| 6,082,852 * | 7/2000 | Soga et al. | 347/86 |

* cited by examiner

*Primary Examiner*—N. Le
*Assistant Examiner*—Anh T. N. Vo
(74) *Attorney, Agent, or Firm*—Luedeka, Neely & Graham

(57) ABSTRACT

The invention relates to an ink jet pen having exposed surfaces which are coated with a polymeric material. The polymeric material is treated with ultraviolet energy at a wavelength and for a period of time sufficient to increase the surface energy of the coating to thereby enhance the adhesive properties of the coating. The coated polymeric material and treated pen exhibits improved corrosion resistance and are more compatible with adhesives used to assemble components of the pen than similar untreated coatings.

17 Claims, 4 Drawing Sheets

CORROSION RESISTANT PRINTHEAD BODY FOR INK JET PEN

FIELD OF THE INVENTION

The invention relates to ink jet printers and in particular to ink jet pens and their components.

BACKGROUND OF THE INVENTION

Thermal ink jet printers use ink pens containing printheads and ink cartridges, the printheads having heating elements on a semiconductor substrate for heating ink so that the ink is imparted with sufficient energy to cause the ink to be ejected through one or more nozzle holes in a nozzle plate attached adjacent to a semiconductor substrate. The nozzle plate typically consists of a plurality of spaced nozzle holes which cooperate with individual heater elements on the substrate to eject ink from the cartridge toward the print media. The number, spacing and size of the nozzle holes influences the print quality. Increasing the number of nozzle holes on a printer cartridge typically increases the print speed without necessarily sacrificing print quality. However, there is a practical limit to nozzle hole or orifice size and to the size of the semiconductor substrate which can be produced economically in high yield. Thus, there is a practical limit to the number of corresponding nozzle holes which can be provided in a nozzle plate for a printhead.

For color printing applications, the three primary colors of cyan, magenta and yellow are used to create a palette of colors. In one ink pen design all three colors are provided by a single ink jet pen containing a single semiconductor chip and a single nozzle plate attached to the chip. However, this results in relatively slow print speeds because each color swath is small due to the size of the portion of chip being used for that color. In order to obtain suitable substrate production yields, the semiconductor chips cannot be large enough to contain the same number of energy imparting devices as would be found on individual printheads for each color.

In an effort to increase printing speed, separate ink pens each containing a semiconductor chip, nozzle plate attached to the chip and ink cartridge are provided for each color. In such a design, the number of nozzle holes per color is maximized for high quality, higher speed printing. However, it is extremely difficult to maintain an alignment tolerance of a few microns between the individual ink pens.

While locating multiple individual substrates of a conventional size on the same ink pen body may allow a relatively faster printing rate, such a design contributes to significantly increasing the printhead temperatures because of the greater number of energy imparting devices located on the printhead and the desire to eject the ink from the pen at a faster rate. Increased printhead temperatures cause problems with ink ejection due to viscosity changes in the ink which may result in oversize ink droplets and well as premature ejection of ink from a nozzle hole. Higher temperatures may also contribute to air bubble formation in the ink chambers of the printhead which air bubbles inhibit ink droplet formation. Plugging of the nozzle holes by a build up of ink decomposition products adjacent the nozzle holes may also be a problem caused by higher printhead temperatures. Furthermore, without adequate temperature control, dimensional changes in the printhead are not predictable making it difficult to achieve the desired dot placement which adversely affects print quality.

Various materials and methods have been proposed for removing heat from the printhead substrates. For example, U.S. Pat. No. 5,084,713 to Wong describes flowing ink from the reservoir through a support panel for the heater substrate to cool the printhead. Such a design requires an adequate flow of ink to the printhead in order to remove sufficient heat therefrom.

U.S. Pat. No. 5,066,964 to Fukuda et al. describes the use of flowing ink in combination with a heat capacity member to remove ink from the printhead in order to cool the printhead. U.S. Pat. No. 5,657,061 to Seccombe et al. describes the use of a heat exchanger in the ink flow path to cool the ink and thus cool the printhead as the ink flows to the substrate. Other methods of removing heat include the use of a heat pipe and blower as described in U.S. Pat. No. 5,451,989 to Kadowaki et al.

Conventionally, materials which exhibit a low thermal expansion coefficient have been used to provide suitable heat removal without sacrificing print quality. Materials having low thermal expansion coefficients do not typically expand or contract a sufficient amount to affect printer operation and thus print quality. The materials also enable easier and cheaper ink jet pen and cartridge fabrication techniques since expansion and/or contraction of the components and electrical connections therebetween are minimized. However, such low thermal expansion materials are typically made from exotic composites such as metal-ceramic mixtures, carbon fiber, or graphite composites which are costly to make and use in such applications.

Heat conductive metals have typically not been used in ink jet pen applications because of difficulties encountered with protecting the metal surfaces from ink corrosion which results when ink mist and non-dried ink on the print media come into contact with the nozzle plate and ink pen body surfaces. Over time, the ink can sufficiently corrode metal surfaces thereby affecting pen life and print quality. Materials which may adequately protect metal surfaces from ink corrosion have had disadvantageous effects on the ability of adhesives used in the assembly of the pen to adhere to the protected surface thereby rending such treatment materials ineffective.

Accordingly, there is a continual need in the art for improved ink jet pen components, particularly ink pen bodies, which effectively dissipate heat and are resistant to the corrosive effects of ink.

SUMMARY OF THE INVENTION

With regard to the foregoing and other objects and advantages, the invention provides a method for protecting exposed portions of an ink jet pen, such as the pen body, against corrosion from ink and minimizing the formation of corrosion products which can contaminate the ink. In accordance with a preferred embodiment of the invention, the method includes the steps of applying a polymeric coating to exposed surfaces of the ink jet pen and treating the coated surfaces by exposing the surfaces to a source of UV energy in the presence of oxygen at a wavelength ranging from about 185 to about 254 nanometers for a period of time sufficient to increase the surface energy of the polymeric coating over the surface energy of the coating in the absence of UV treatment. Portions of the pen, such as the pen body, are preferably made of a heat dissipating material, such as metal.

In another embodiment, the invention provides an ink jet pen having exposed surfaces thereof coated with a polymeric material and exposed to a source of UV energy in the presence of oxygen at a wavelength ranging from about 185 to about 254 nanometers for a period of time sufficient to increase the surface energy of the polymeric coating over the surface energy of the coating in the absence of UV treatment.

It has been observed that the surfaces of the pen treated in accordance with the invention exhibit improved resistance to corrosion and are significantly more receptive to adhesives. This advantageously enables convenient treatment of corrosion-prone surfaces without detrimentally affecting conventional ink jet pen manufacturing techniques of the type which utilize adhesives for joining components of the pen to one another.

BRIEF DESCRIPTION OF THE DRAWINGS

Further advantages of the invention will become apparent by reference to the detailed description when considered in conjunction with the figures, which are not to scale, wherein like reference characters indicate like elements throughout the several views and wherein.

DETAILED DESCRIPTION OF THE INVENTION

Figure 1:
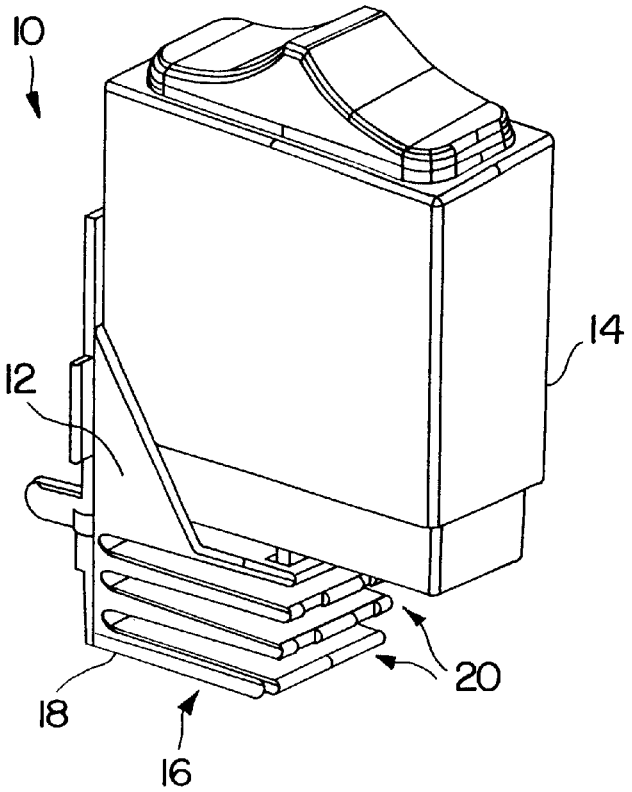
FIG. 1 is a perspective view of an ink jet pen in accordance with the invention.

With reference to FIG. 1, there is shown an ink jet pen 10 having a permanent or semi-permanent pen body 12 attachable to an ink cartridge 14 for providing ink to an ink jet printhead 16 disposed on a lower surface 18 of the pen body 12 opposite the side of the pen body 12 containing the ink cartridge 14. The pen body 12 may be configured to attach to a single ink cartridge 14 or may be expanded to hold multiple cartridges 14 for supplying ink to multiple printheads 16. In the case of multiple cartridges 14 or a multicolor cartridge 14 attached to the pen body 12, the pen body 12 contains multiple printheads 16, typically three or four printheads.

In high speed, high quality printing operations, it is preferred that the pen body 12 be adapted to remove heat from the printhead or printheads 16 attached thereto. This may be accomplished by constructing a portion of or the entire pen body 12 out of a heat conducting metal such as zinc, aluminum, stainless steel, and other metals and alloys and/or by providing heat conducting fins 20 on the pen body 12 to conduct heat away from the printhead(s) 16 by conduction and convection. The ink cartridge 14 is preferably made of a polymeric thermoplastic material which is resistant to ink such as polyethylene or polypropylene, but may also be made of a heat conducting material if desired.

Figure 1A:
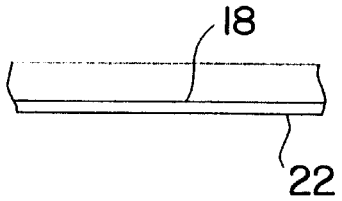
FIG. 1*a* is a close-up view of a portion of a pen body containing a coating applied thereto.

Metal surfaces of the ink jet pen 10 which tend to be subject to corrosion from the ink are preferably treated to enhance resistance of the exposed surfaces to corrosion. This may be accomplished by applying a protective coating 22 (FIG. 1*a*) to all or selected surfaces of the pen body 12, such as surface 18. The protective coating 22 is preferably applied by vapor deposition techniques.

Figure 2:
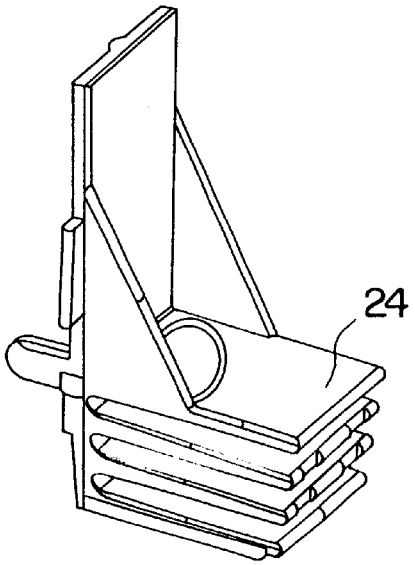
FIG. 2 is a perspective view showing exposed surfaces of an ink jet pen body in accordance with the invention.

All metal surfaces of the pen body 12 may be coated as described, however, it is preferred to coat at least those surfaces of the pen body 12 which are particularly prone to corrosion from exposure to ink and especially surfaces of the pen body, such as surface 18 for attachment thereto of printhead(s) 16. In addition to surface 18, surface 24 (FIG. 2) of the pen body 12 where the cartridge 14 is attached and rests on the pen body 12 may also be prone to corrosion. Thus it may be desirable to also treat surface 24 in accordance with the invention.

Figure 3:
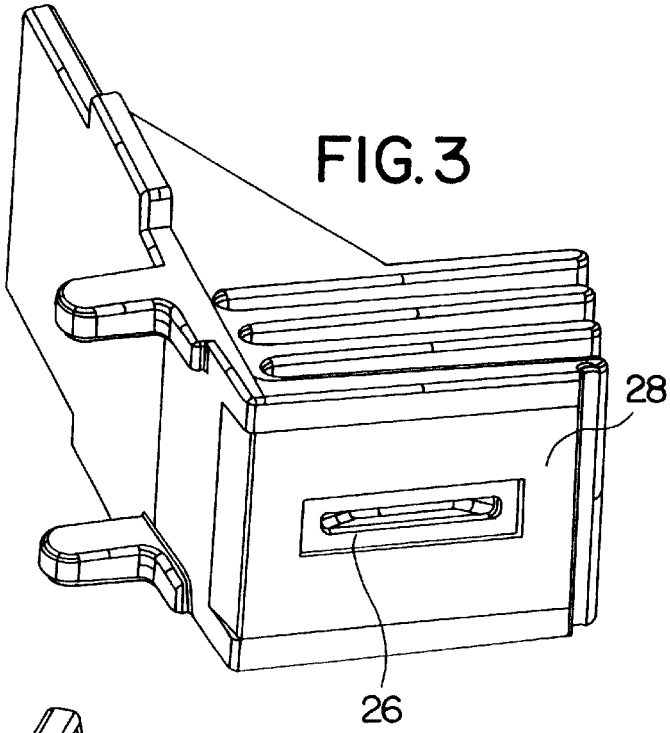
FIG. 3 is a bottom perspective view showing exposed surfaces of a pen body in accordance with the invention.
Figure 4:
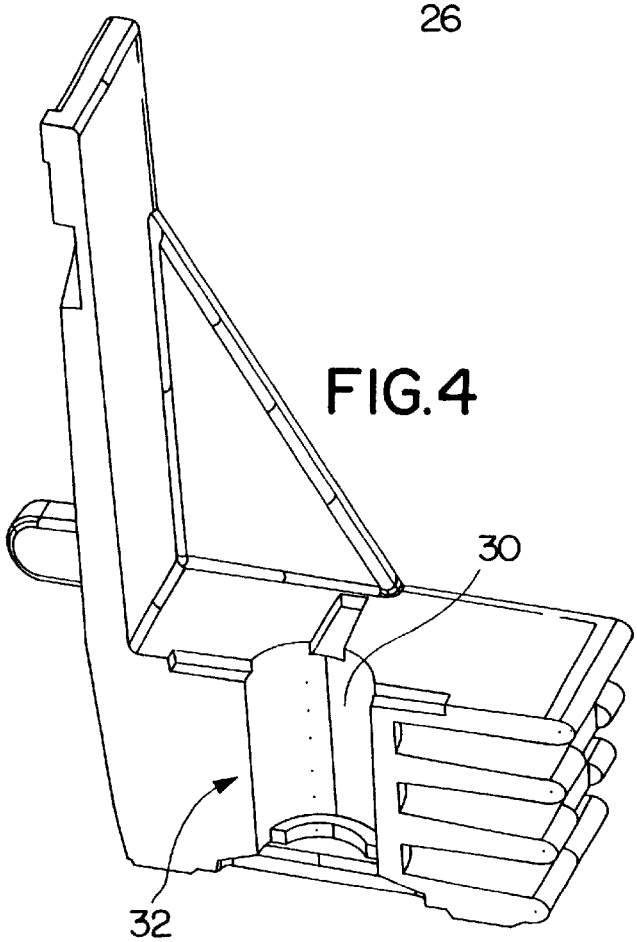
FIG. 4 is a cut-away view showing exposed surfaces of a pen body in accordance with the invention.

FIGS. 3 and 4 illustrate other metal surfaces which may be protected according to the invention. With reference to FIG. 3, cavity 26 which receives the printhead and surrounding area 28 may be treated according to the invention to reduce corrosion from ink. As seen in FIG. 4, surface 30 of the filter tower connection port 32 may also be treated according to the invention.

A preferred coating material is a polymeric coating material, preferably a xylylene-based coating, most preferably dichloro-di-p-xylylene. Preferred dichloro-di-p-xylylene coating materials are available under the tradenames Parylene-N, Parylene-C and Parylene-D from Union Carbide Corporation of Danbury, Connecticut. The coating is preferably applied at a thickness ranging from about 2 to about 50 microns, most preferably about 2–25 microns for thermal management, and even more preferably about 12 microns for optimum thermal management and corrosion protection.

It has been discovered that a dichloro-di-p-xylylene based coating renders the printhead body substantially resistant to inks of the type common to ink jet printing applications. However, it has also been discovered that dichloro-di-p-xylylene based coatings are less receptive to the adhesives typically used to attach ink jet pen components, such as the silicon chip, TAB circuit and nozzle plate to the pen body 12 than other types of coating materials. Examples of such adhesives include a die-attach adhesive available under the tradename POLYSOLDER LT from Alpha Metals, Inc. of Jersey City, N.J.; a bonding film available under the tradename SCOTCH-WELD 583 from 3M Corporation of St. Paul, Minn.; and a phenolic butyral type adhesive available under the tradename 1000 B200 from Rogers Corporation of Rogers, Conn. The die attach adhesive is typically used to attach the silicon substrate to the pen body 12 and the other adhesives are typically used to attach a TAB circuit to the pen body.

It has been discovered that the receptiveness to adhesives of dichloro-di-p-xylylene based coatings 22 (FIG. 1*a*) may be significantly enhanced by treating the coating with ultraviolet (UV) energy in a wavelength sufficient to produce ozone from oxygen present in the treatment chamber. A preferred UV lamp apparatus is a low pressure quartz-mercury vapor lamp which generates UV emmissions in the 254 and the 185 nanometer ranges and is available from UVOCS, Inc. of Montgomeryville, Pa.

The UV treatment is preferably conducted in the presence of atmospheric oxygen at dosage rate of from about 200 to about 400 mJ/cm$^2$, preferably at a dosage rate ranging from about 220 to about 260 mJ/cm$^2$. The dosage rate used is dependent on the distance of the coated surface to be treated from the UV radiation source and intensity or energy output of the UV radiation source. At greater distances from the UV source, higher dosage rates are required for a given radiation intensity to obtain the same surface energy increasing effect.

The amount of time the coated surface is exposed to the UV energy source typically ranges from a few seconds to less than about a minute. Longer exposure times are not preferred as they may excessively degrade the coating 12 at the preferred wavelength and dosage rate.

The effectiveness of UV treatment for increasing the surface energy of the coating is dependent on the dosage rate applied to the coating and the coating thickness. Coating thicknesses preferably range from about 5 to about 50 microns.

Without being bound by theory, it is believed that atmospheric oxygen which is present in the chamber during initial treatment absorbs the 185 nm UV energy, converting the oxygen to ozone. At 254 nm or above, the ozone in the chamber absorbs the UV energy causing it to revert to oxygen. However, upon generation of ozone adjacent the coated surfaces, organic molecules on the coated surface are oxidized by reaction with ozone to form free radicals and oxygen functional groups which thereby change the surface chemistry of the coating to yield a higher surface energy coating more suitable for adhesion purposes. In contrast, UV treatment of coatings in the absence of oxygen or at wavelengths below about 185 nm are less effective for increasing the surface energy of such xylylene coatings.

Figure 5:
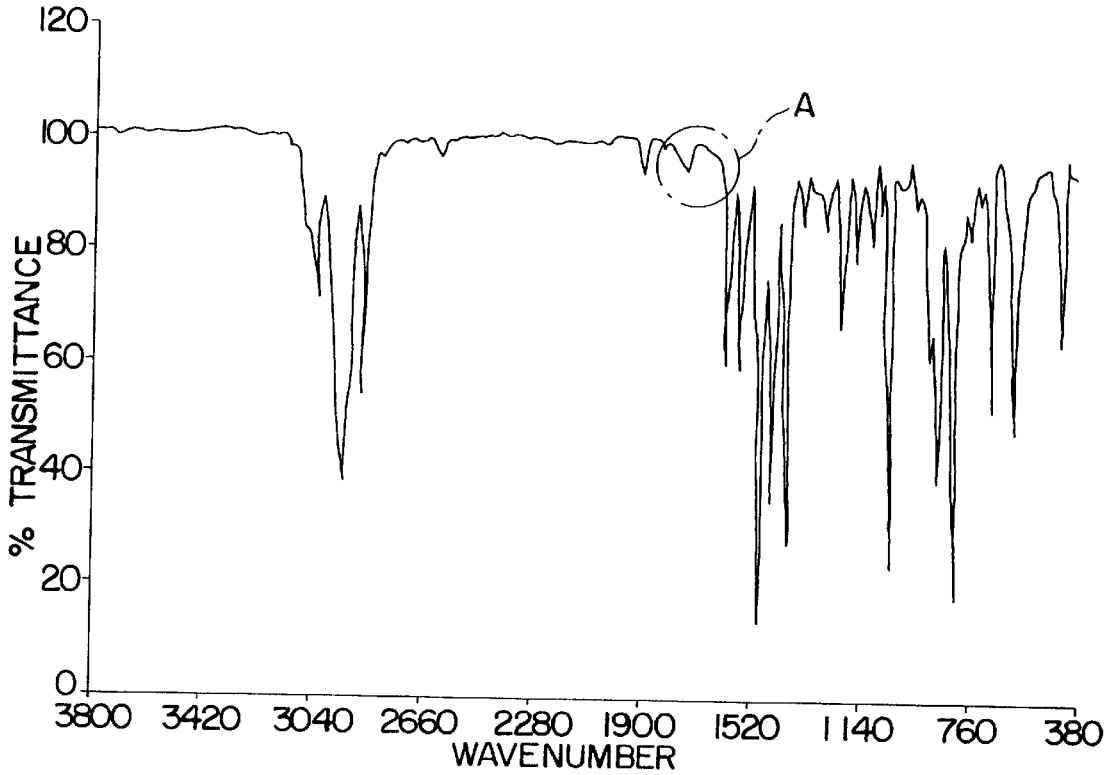
FIGS. 5 and 6 are spectroscopic traces showing oxygen concentration of the coating before and according to the invention.
Figure 6:
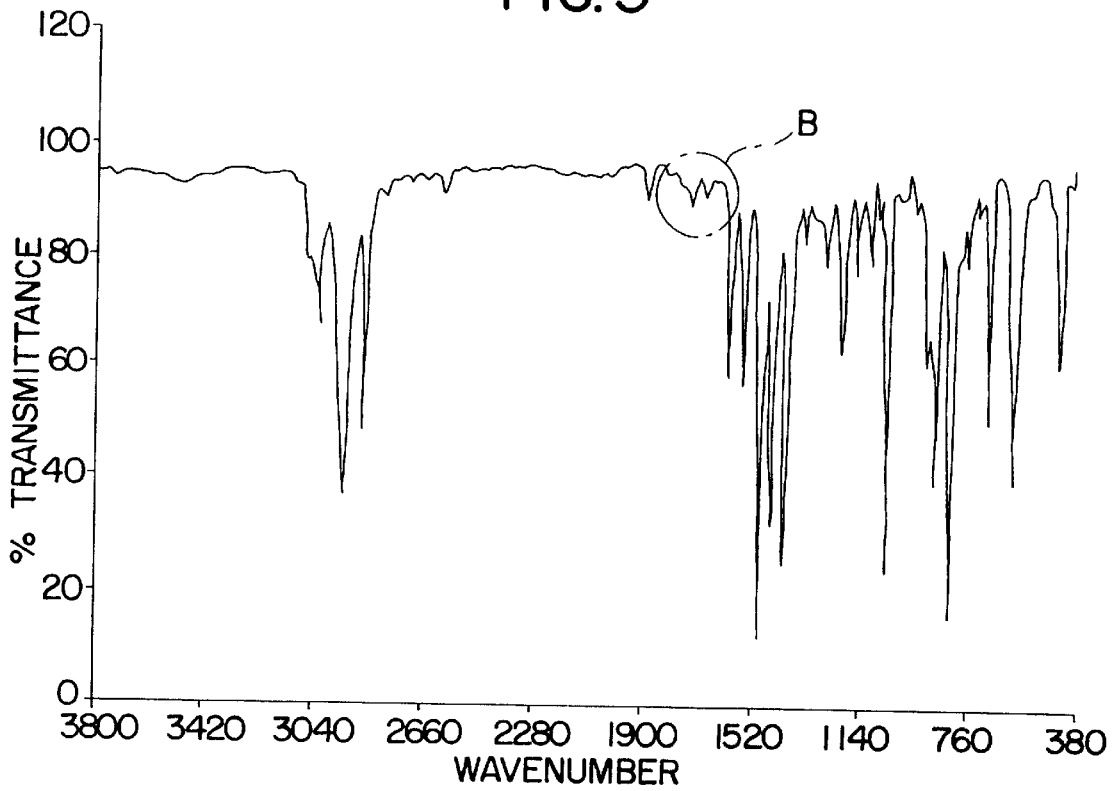
Figure 5A:
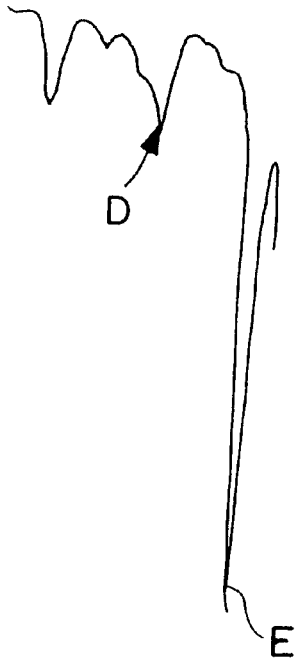
FIGS. 5*a* and 6*a* are relevant portions of the spectroscopic traces of FIGS. 5 and 6.
Figure 6A:
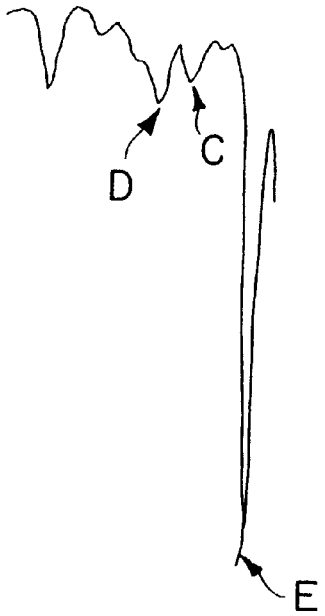

Both reflection absorption infrared spectroscopy and x-ray photoelectron spectroscopy were performed on treated and untreated coatings and confirmed an increase in the total oxygen concentration for UV treated coatings according to the invention over the same coating without UV treatment. Spectroscopy traces of the treated and untreated coatings are shown in FIGS. 5 and 6 respectively. An increase in total oxygen concentration on the surface of the coating as a result of UV treatment according to the invention is evidenced by the increase in peaks in the 1900 to 1520 wavelength range in FIG. 6(B). The relevant portions of the traces for comparison purposes are in the circled areas marked A and B. Enlarged sections of the traces of FIGS. 5 and 6 are shown in FIGS. 5*a* and 6*a* respectively. As seen in FIG. 6*a* there is an additional oxygen peak C between peaks D and E which is absent from the same section of the trace shown in FIG. 5*a*. In all other respects, the traces are similar.

Contact angle measurements of the coated samples before and after treatment evidenced an increase in surface energy from about 25 to about 30 dynes/cm$^2$ before UV treatment to about 32 to about 42 dynes/cm$^2$ after UV treatment according to the invention. An increase in surface energy of the coating results in an increase in adhesion between the coating and adhesives used to attach components to the coated surfaces as described in more detail below.

Treatment of the coatings 22 on the ink jet pen surfaces as described above was observed to significantly increase the adhesion receptive properties of the coatings. The following examples illustrate the effectiveness of coating and treatment of the coating according to the invention.

EXAMPLE 1

Aluminum plaques having the dimensions of 2.5 mm by 2.5 mm by 1 mm thick were coated with 12.5 microns of parylene-C (dichloro-di-p-xylylene). Several plaques were then placed in a UVOC chamber and treated with UV radiation at a dosage rate of 240 mJ/cm$^2$ in the presence of atmospheric oxygen while other plaques were coated with parylene-C but not treated with UV radiation. Die shear samples were prepared from the plaques by adhering silicon pieces to the treated and untreated plaques. The silicon specimens used were 4 mm wide by 13 mm long by 0.625 mm thick. Epoxy based adhesives were dispensed on the back side of the silicon specimens using a fluid dispense unit from EFD, Inc. of East Providence, R.I. having a dispense tip with a #20 gauge needle. Silicon specimens were then placed on the parylene-C coated surface and cured under manufacturer's specified conditions for curing the adhesive and a bondline of 0.3 to 0.4 mm was obtained. After 24 hours hold time at ambient temperature, die shear tests were performed on the samples using an INSTRON 1123 tester from Instron Corporation of Southfield, Mich. During the shear testing, a force was applied to the silicon specimens parallel to the long axis of the specimens. The force to failure and mode of failure of the adhesive between the silicon specimen and the aluminum plaques was recorded. The average load to failure in pounds for two different epoxy adhesives (A and B) are given in the following table.

TABLE 1

| Adhesive | Pounds to Failure (No UV treatment) | Pounds to Failure (UV treated Coatings) |
|---|---|---|
| A | 3 | 34 |
| B | 5 | 27 |

Results of the foregoing tests indicate that UV treatment of the paralyene-C coated samples significantly increased the shear force required to shear the silicon specimens from the coated aluminum samples treated with UV radiation from about 5 to more than 10 times over the force required to shear silicon specimens from aluminum samples which had not be treated with UV radiation according to the invention. In all cases, adhesion failure at the shear force indicated occurred at the coating/adhesive interface.

EXAMPLE 2

Aluminum plaques having the dimensions of 25 mm by 25 mm by 1 mm thick were coated with 12.5 microns of parylene-C (dichloro-di-p-xylylene). Several plaques were then placed in a UVOC chamber and treated with UV radiation at an intensity of 19.9 mm measured with the radiometer and a UV wavelength of 254 nm at a distance of 12 mm from the radiation source in the presence of atmospheric oxygen. Other plaques were coated with parylene-C but not treated with UV radiation. Polyimide strips (KAPTON HN from Dupont Chemical Company of Wilmington, Del.) 10 mm wide by 80 mm long by 0.05 mm thick were adhered to the coated plaques with 0.5 mm thick thermoset bonding films under the manufacturer's specified conditions. The bonding films used were (a) 1000 B200 phenolic adhesives from Roger's Corporation and (b) 3M 583 phenolic adhesive from 3M Corporation. Adhesive (a) was placed between the parylene-C and polyimide strips and tacked at 80° C. for 5 seconds under 40 psi pressure and then cured in an oven at 175° C. for 1 hour. Adhesive (b) was placed between the parylene-C and polyimide strips and tacked at 200° C. for 15 seconds under 40 psi pressure and then cured in an oven at 175° C. for 1 hour. Each of the adhesive strips used were 2.25 mm wide by 10 mm long. After 24 hours hold time at ambient temperture, 90 degree peel tests were performed on the samples using an INSTRON 1123 tester. During the peel tests, a cross-head speed of 20 mm/minute was used. The peel force required to remove the polyimide strips from the coated samples was recorded and is given in the following table for each of the adhesives used.

TABLE 2

| Adhesive | UV treatment time (sec) | Peel Force (grams) 90° Peel test |
|---|---|---|
| a | 0 | 23 |
| a | 15 | 1135 |
| b | 0 | 45 |
| b | 15 | 1135 |

Results of the foregoing tests indicate that UV treatment of the paralyene-C coated samples significantly increased the peel force required to remove the polyimide strips from the coated aluminum samples treated with UV radiation from about 25 to more than 50 times over the force required to peel the polyimide strips from aluminum samples which had not be treated with UV radiation according to the invention.

The foregoing description of certain embodiments of the invention has been provided for the purposes of illustration only, and it is understood that various modifications or alterations may be made without departing from the spirit and scope of the invention as set forth in the following claims.

What is claimed is:

1. A method for protecting exposed surfaces of an ink jet pen or pen body against corrosion from ink, the method comprising the steps of applying a polymeric coating to at least one of the exposed surfaces of the pen, inserting the ink jet pen in an ultraviolet (UV) treatment chamber and exposing the polymeric coating to a source of UV energy and oxygen at a wavelength ranging from about 185 to about 254 nanometers for a period of time sufficient to increase a surface energy of the polymeric coating over a surface energy of the coating without UV treatment, the period of time ranging from a few seconds to less than about a minute.

2. The method of claim 1, wherein the polymeric coating comprises a xylylene based coating.

3. The method of claim 2, wherein the xylylene based coating comprises dichloro-di-p-xylylene.

4. The method of claim 1, wherein the coating is applied in a thickness of no more than about 50 microns.

5. The method of claim 1, wherein the exposed surfaces comprise exposed surfaces of a ink jet pen body.

6. The method of claim 5, wherein the ink jet pen body comprises a metal pen body.

7. The method of claim 1, wherein the source of UV energy comprises UV energy at a dosage rate ranging from about 200 mJ/cm$^2$ to about 400 mJ/cm$^2$.

8. A metal ink jet pen body for an ink jet printer having enhanced corrosion resistance properties, the pen body comprising at least one surface coated with a polymeric material and the polymeric material coated surface being exposed to a source of ultraviolet (UV) energy in a UV treatment chamber at a wavelength ranging from about 185 to about 254 nanometers in the presence of atmospheric oxygen for a period of time ranging from a few seconds to less than about a minute.

9. The pen body of claim 8, wherein the polymeric coating comprises a xylylene based material.

10. The pen body of claim 9, wherein the xylylene based material comprises dichloro-di-p-xylylene.

11. The pen body of claim 8, wherein the polymeric material is applied as a coating in a thickness of no more than about 50 microns.

12. The printhead body of claim 8, wherein the polymeric material coated surface is exposed to the UV energy from a source of UV energy which is placed at a distance of from about 0.5 to about 1.0 inches from the coated surface and the source of UV energy is operated at an energy intensity ranging from about 19 to about 20 mW/cm$^2$.

13. An ink jet pen, comprising an ink cartridge attachable to a pen body having a printhead thereon in flow communication with the ink cartridge, wherein the pen body comprises a metal body having one or more surfaces thereof coated with a polymeric material wherein the polymeric material is exposed to a source of ultraviolet (UV) radiation at a wavelength and for a period of time sufficient to increase a surface energy of the polymeric material, the period of time ranging from a few seconds to less than about a minute.

14. The pen of claim 13, wherein the polymeric material comprises a xylylene based material.

15. The pen of claim 14, wherein the xylylene based material comprises dichloro-di-p-xylylene.

16. The pen of claim 15, wherein the xylylene based material is applied in a thickness of no more than about 25 microns.

17. The pen of claim 13, wherein the source of UV radiation comprises a source of UV energy which generates UV radiation in the range of 185 and 254 nanometers and wherein the one or more coated surfaces are exposed to UV radiation at a dosage rate ranging from about 200 mJ/cm$^2$ to about 400 mJ/cm$^2$.

* * * * *